US007977241B2

(12) United States Patent
Gutierrez et al.

(10) Patent No.: US 7,977,241 B2
(45) Date of Patent: Jul. 12, 2011

(54) METHOD FOR FABRICATING HIGHLY RELIABLE INTERCONNECTS

(75) Inventors: Edward R. Gutierrez, Phoenix, AZ (US); William J. Bellamak, Gilbert, AZ (US); Daniel Davison, Queen Creek, AZ (US); Gregory D. Hale, Chandler, AZ (US); James F. Vannell, Tempe, AZ (US)

(73) Assignee: Freescale Semiconductor, Inc., Austin, TX (US)

( * ) Notice: Subject to any disclaimer, the term of this patent is extended or adjusted under 35 U.S.C. 154(b) by 173 days.

(21) Appl. No.: 11/961,392

(22) Filed: Dec. 20, 2007

(65) Prior Publication Data

US 2008/0153394 A1 Jun. 26, 2008

Related U.S. Application Data

(60) Provisional application No. 60/871,116, filed on Dec. 20, 2006.

(51) Int. Cl.
*H01L 21/302* (2006.01)
*H01L 21/461* (2006.01)

(52) U.S. Cl. ..... 438/692; 438/906; 257/E21.23; 414/935

(58) Field of Classification Search ..... 438/906, 438/692; 257/E21.23; 414/935; 451/247, 451/288

See application file for complete search history.

(56) References Cited

U.S. PATENT DOCUMENTS

| | | | | |
|---|---|---|---|---|
| 5,331,987 | A * | 7/1994 | Hayashi et al. | 134/102.1 |
| 5,738,574 | A * | 4/1998 | Tolles et al. | 451/288 |
| 5,893,753 | A * | 4/1999 | Hempel, Jr. | 438/691 |
| 6,277,742 | B1 | 8/2001 | Wang et al. | |
| 6,292,265 | B1 * | 9/2001 | Finarov et al. | 356/630 |
| 6,443,815 | B1 * | 9/2002 | Williams | 451/56 |
| 6,517,637 | B1 * | 2/2003 | Fu et al. | 134/6 |
| 6,703,301 | B2 | 3/2004 | Tai et al. | |
| 2003/0164338 | A1 * | 9/2003 | Fittkau et al. | 210/760 |
| 2004/0266180 | A1 | 12/2004 | Dauch et al. | |
| 2005/0090101 | A1 | 4/2005 | Jacobs et al. | |
| 2005/0090112 | A1 | 4/2005 | Jacobs et al. | |

* cited by examiner

*Primary Examiner* — Savitri Mulpuri
*Assistant Examiner* — Calvin Choi

(57) ABSTRACT

A method of fabricating highly reliable tungsten interconnects takes into consideration the effects of charging that can occur within a CMP apparatus due to unrestricted DI water flow, limited only by house supply. Such effects are addressed with the use of a variable pressure input constant flow output in-line controller to the DI water line coupled to the head cleaning loading and unloading module of the CMP apparatus.

16 Claims, 6 Drawing Sheets

IMPROVED PRATICE

"Prior Art"

| WAFER UNLOAD SEQUENCE | |
|---|---|
| HCLU | REASON |
| N2 VENT ORIFICES | |
| VACCUM | CARRIER HEAD UNLOAD |
| HIGH PRESSURE DI WATER | ROBOT LOAD |
| HIGH PRESSURE DI WATER | EMPTY CARRIER CLEAN |

| WAFER LOAD SEQUENCE | |
|---|---|
| HCLU | REASON |
| N2 VENT ORIFICES | |
| VACCUM | ROBOT UNLOAD |
| HIGH PRESSURE DI WATER | CARRIER HEAD LOAD |
| HIGH PRESSURE DI WATER | EMPTY CARRIER CLEAN |

| ROTOMETER SETTING | DI FLOW ML/MIN |
|---|---|
| 2.5 | 770 |
| 3.0 | 833 |
| 3.5 | 913 |
| 4.0 | 1009 |
| 4.5 | 1097 |
| NO ROTOMETER IN LINE (CURRENT PROCESS) | 6150 |

METHOD FOR FABRICATING HIGHLY RELIABLE INTERCONNECTS

CROSS-REFERENCE TO CO-PENDING APPLICATION

This application claims priority to provisional patent application Ser. No. 60/871,116 entitled "METHOD FOR FABRICATING HIGHLY RELIABLE INTERCONNECTS," filed on Dec. 20, 2006, and assigned to the assignee of the present application.

BACKGROUND

1. Field

This disclosure relates generally to semiconductor manufacturing and processing, and more specifically, to methods for fabricating highly reliable interconnects.

2. Related Art

Problems in the art include, for example, premature via failures due to tungsten plug corrosion that is not otherwise detectable through in-line, end of line, or final test screening. Problems in the art further include yield decrease due to localized charging that can occur at an inter-layer dielectric (ILD) polish portion of a semiconductor device manufacturing process. Furthermore, prior known processing techniques do not address tungsten corrosion or localized charging resulting from chemical mechanical polishing (CMP) processing.

Accordingly, there is a need for an improved method for overcoming problems in the art as discussed above.

BRIEF DESCRIPTION OF THE DRAWINGS

The present invention is illustrated by way of example and is not limited by the accompanying figures, in which like references indicate similar elements. Elements in the figures are illustrated for simplicity and clarity and have not necessarily been drawn to scale.

DETAILED DESCRIPTION

A method for fabricating highly reliable interconnects, according to the embodiments of the present disclosure, advantageously addresses the issues of (i) uncontrolled deionized (DI) water flow dispensed through small orifices over an inter-layer dielectric (ILD) and (ii) exposed tungsten plugs which undesirably leads to localized charging and subsequent galvanic reactions (for example, in the case of tungsten plugs) or arcing (for example, in the case of bulk ILD). The method according to the embodiments of the present disclosure includes reducing water flow to an appropriate level, wherein reducing the water flow to the appropriate level eliminates the undesirable charging and the attendant defects. The method according to the embodiments of the present disclosure comprises the installation of a variable pressure input constant flow output regulator to reduce DI water flow contacting the polished wafer surface during CMP processing to the desired appropriate level.

As described herein, semiconductor substrate can be any semiconductor material or combinations of materials, such as gallium arsenide, silicon germanium, silicon-on-insulator (SOI), silicon, monocrystalline silicon, the like, and combinations of the above.

Figure 1:
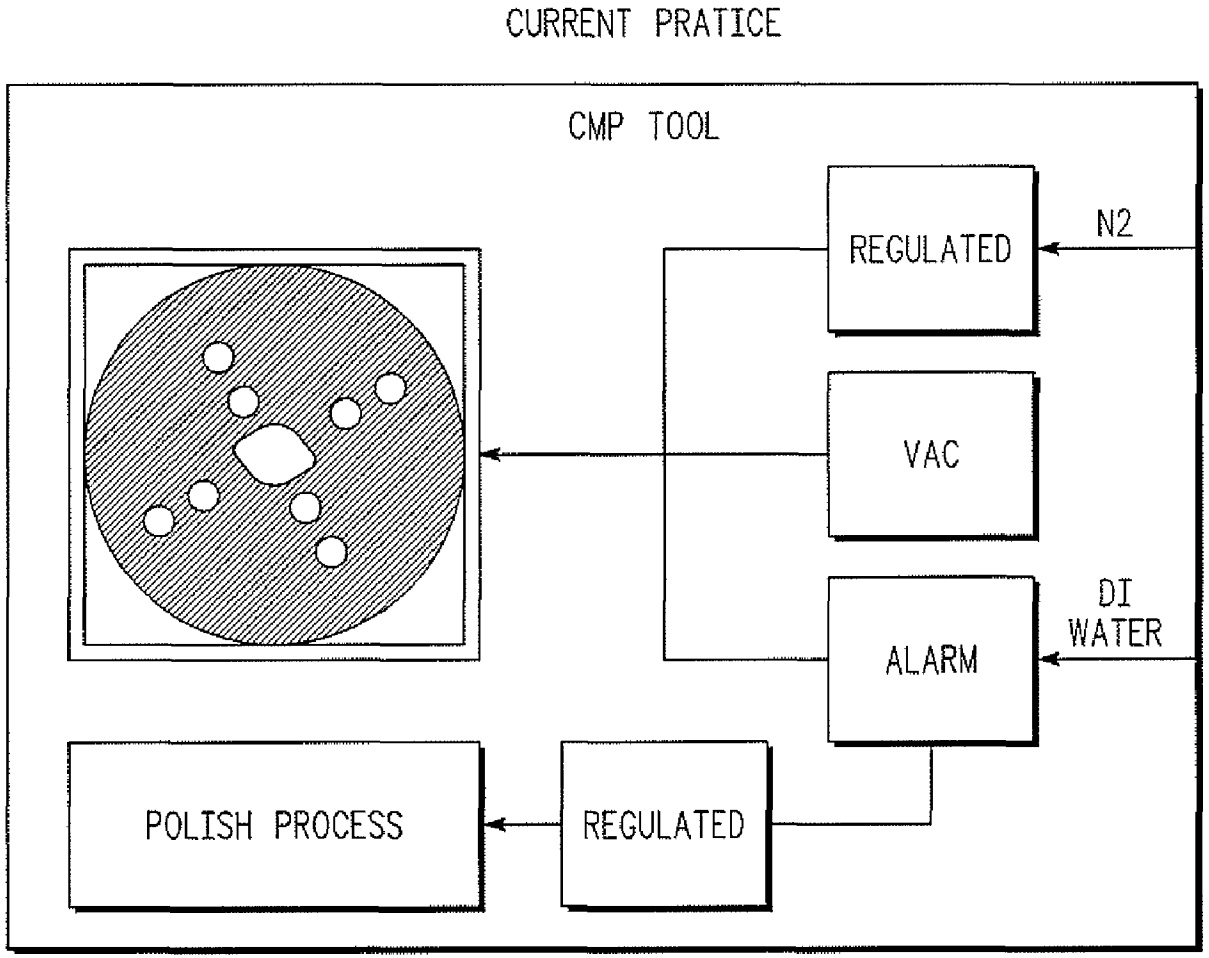
FIG. 1 is a block diagram view of a CMP tool according to a current practice in the art.

FIG. 1 is a block diagram view of a CMP tool according to a current practice in the art. The current practice makes use of a CMP tool in which a polish process is carried out. A wafer handler is used for loading and unloading a wafer to be processed by the CMP tool. There exist nine (9) orifaces in the head cleaning load and unload (HCLU) module pad/plate that apply vacuum, vent with N2 and spray DI water onto the wafer or the membrane of the carrier head. Various elements of the CMP tool are identified directly on the drawing figure.

In particular, FIG. 1 illustrates the head cleaning load and unload (HCLU) module of a current CMP process. The HCLU module has a number of inputs, which include DI water, vacuum, and regulated nitrogen. The HCLU performs many functions, some of which require vacuum, some of which require DI water spraying out of the head, and others require a nitrogen ($N_2$) purge. All three are inputs to the HCLU. Each of the DI water, vacuum, and $N_2$ are coupled to the HCLU head through orifices located within cut-outs in the HCLU pad. DI water sprays out of the orifices in the form of a water jet. Nitrogen is blown out of the orifices. In addition, vacuum is applied to the orifices, as needed.

Figures 2, 3, 4:
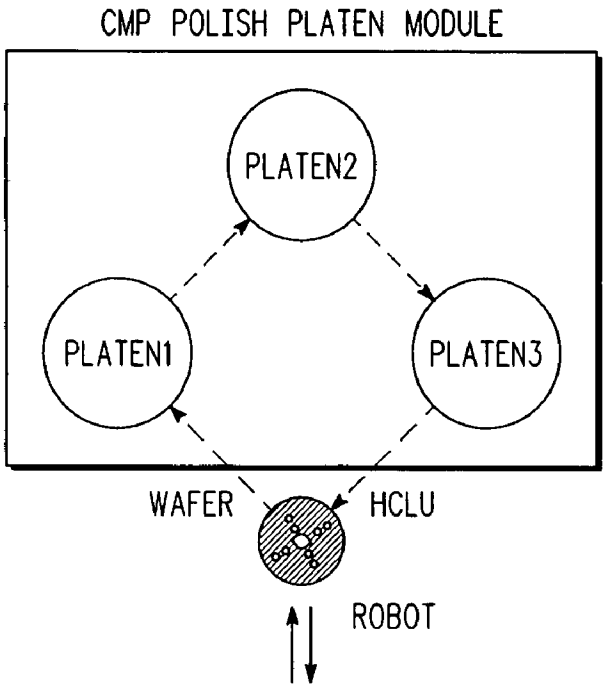
FIG. 2 is a block diagram view of a CMP polish platen module according to a current practice in the art.
FIG. 3 is a table view of a wafer unload sequence as implemented in a current practice with respect to the CMP tool of FIG. 1.
FIG. 4 is a table view of a wafer load sequence as implemented in a current practice with respect to the CMP tool of FIG. 1.

FIG. 2 is a block diagram view of a CMP polish platen module according to a current practice in the art. In the illustration of FIG. 2, a wafer is transported via a wafer carrier head from one platen to another during wafer processing. That is, the CMP polish platen module includes a wafer being transported between three (3) platens via a wafer carrier head. Various elements of the CMP polish platen module are identified directly on the drawing figure. A robot arm loads and unloads a wafer onto and off of the HCLU.

FIG. 3 is a table view of a wafer unloading sequence as implemented in a current practice with respect to the CMP tool of FIG. 1. The wafer unload sequence includes: N2 venting of orifices to clear out the same, prior to the wafer carrier head delivering the wafer to the HCLU, vacuum applied—carrier head unload, high pressure DI water—robot load, and high pressure DI water—empty carrier clean. The step of high pressure DI water for the robot unload has been discovered to generate defective interconnects, resulting in premature via failure.

FIG. 4 is a table view of a wafer load sequence as implemented in a current practice with respect to the CMP tool of FIG. 1. The wafer load sequence includes: N2 venting of orifices, vacuum—robot unload, high pressure DI water—carrier head load, and high pressure DI water—empty carrier clean.

Figure 5:
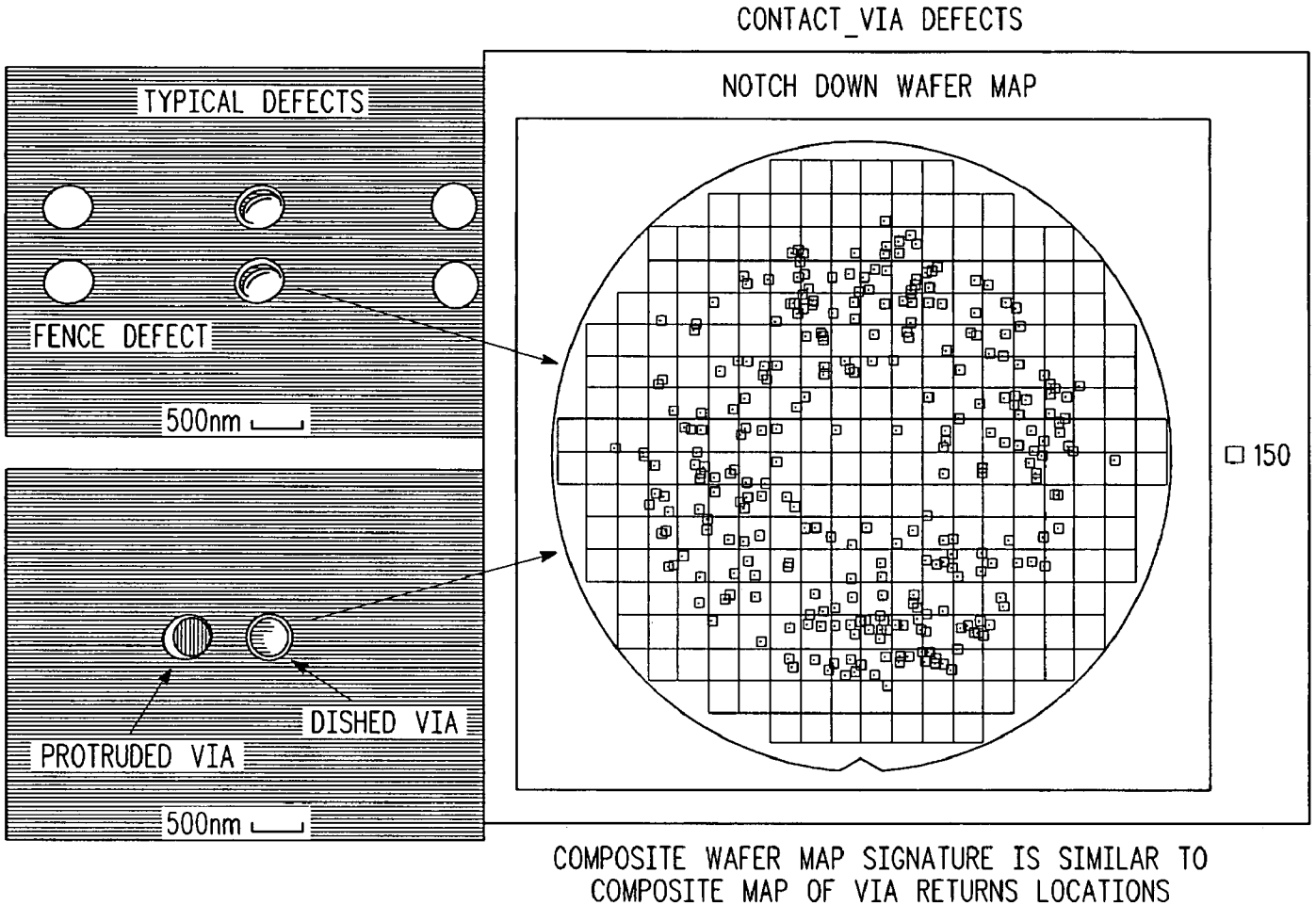
FIG. 5 is a diagram view of various types of contact via defects, including a notch down wafer map, illustrating problems in the art.

FIG. 5 is a diagram view of various types of contact via defects, including a notch down wafer map, illustrating problems in the art. Typical defects include fence defects, protruded vias, and dished vias. A composite wafer map signature is shown that illustrates one example of various locations of contact via defects on a wafer.

Figure 6:
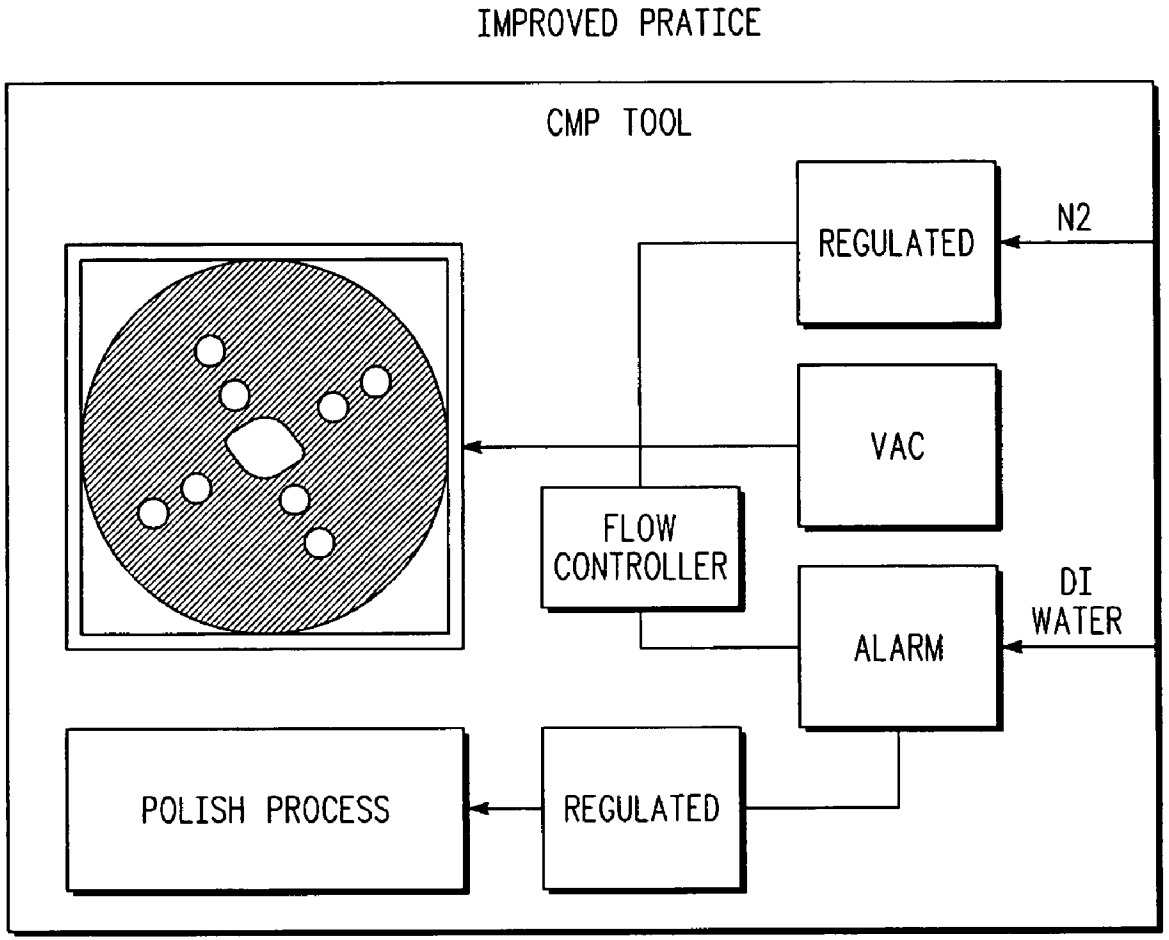
FIG. 6 is a block diagram view of an improved CMP tool according to an embodiment of the present disclosure.

FIG. 6 is a block diagram view of an improved CMP tool according to an embodiment of the present disclosure. The improved CMP tool includes a flow controller configured for providing a predetermined control of flow for the DI water. In one embodiment, the flow control comprises a variable pressure input constant flow output in-line controller. In one embodiment, the predetermined control of flow for the DI water is in the range of 750 ml/min to 1100 ml/min. In another embodiment, the predetermined control of flow for the DI water is on the order of 1000 ml/min. Various elements of the improved CMP tool are identified directly on the drawing figure.

Figure 7:
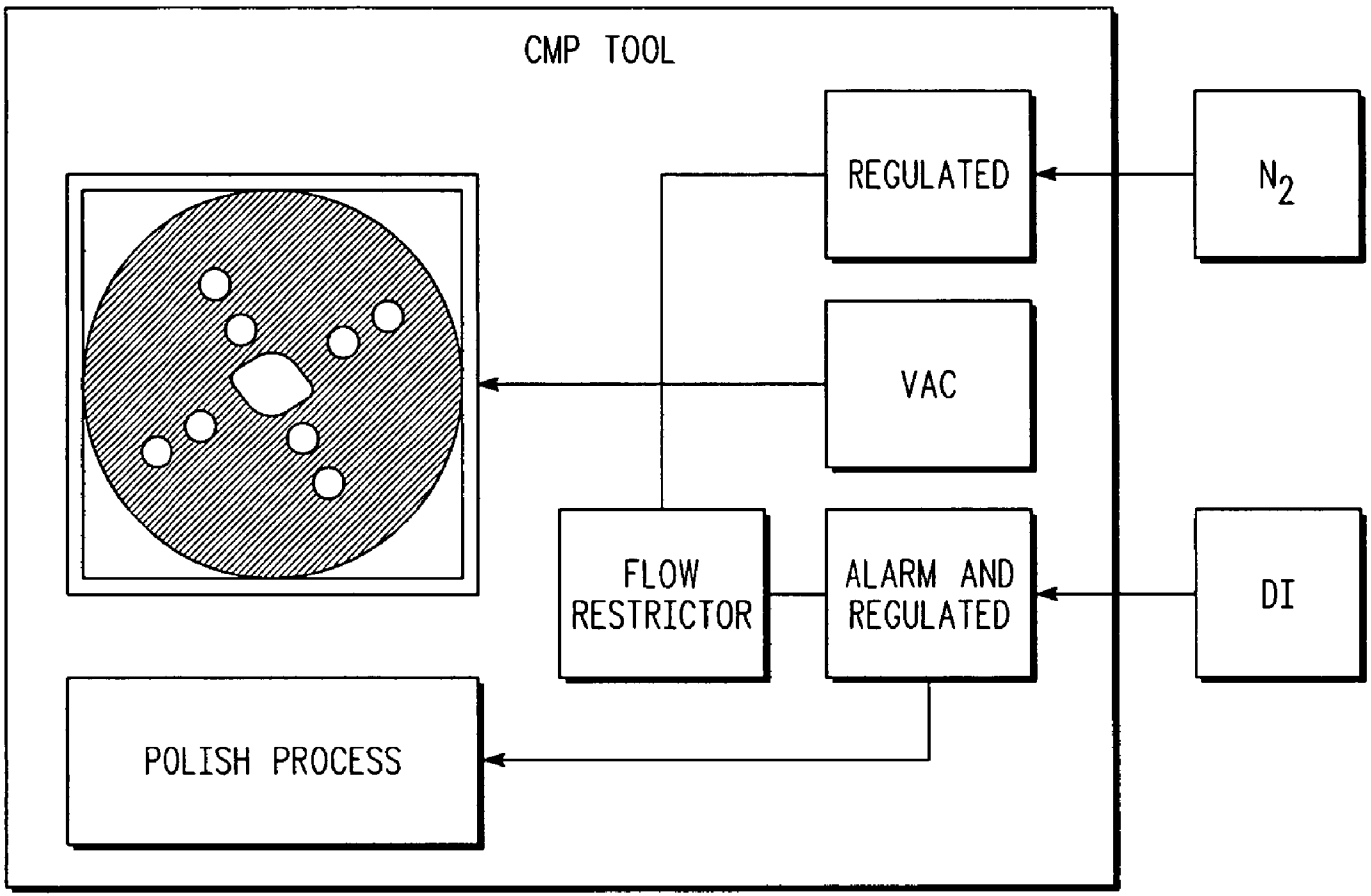
FIG. 7 is a block diagram view of an improved CMP tool according to another embodiment of the present disclosure.

FIG. 7 is a block diagram view of an improved CMP tool according to another embodiment of the present disclosure. The embodiment of FIG. 7 is similar to that of FIG. 6 with the following difference. Alarmed and regulated DI water flow is passed through a flow restrictor, prior to being fed to the orifaces in the (HCLU) pad/plate that spray the DI water onto the wafer or the membrane of the carrier head.

Figures 8, 9:
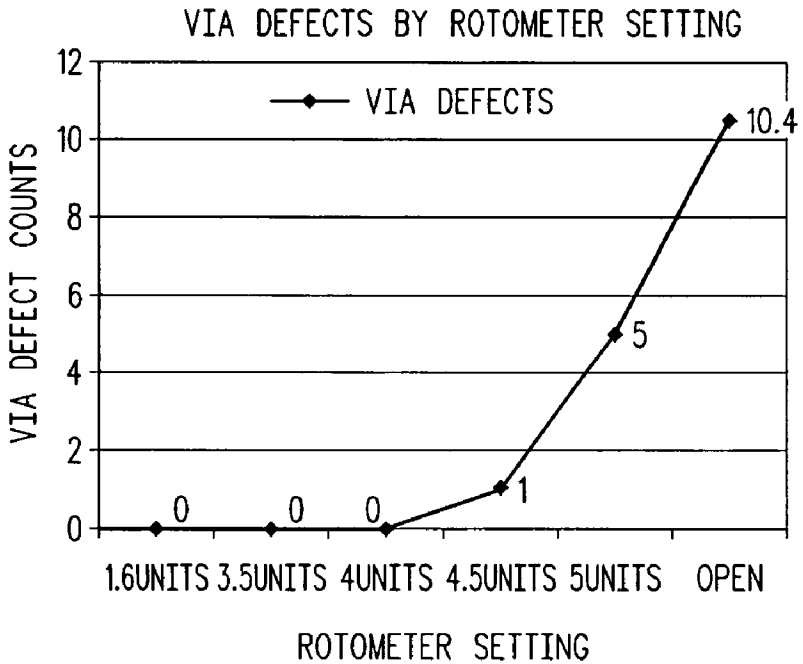
FIG. 8 is a graphical representation view of via defects versus rotometer setting as applied to the improved CMP tool according to an embodiment of the present disclosure.
FIG. 9 is a table diagram view of rotometer settings and DI flow as applied to the improved CMP tool according to an embodiment of the present disclosure and current practice.

FIG. 8 is a graphical representation view of via defects versus rotometer setting as applied to the improved CMP tool according to an embodiment of the present disclosure. FIG. 9 is a table diagram view of rotometer settings and DI flow as applied to the improved CMP tool according to an embodiment of the present disclosure and current practice. In one embodiment, a variable flow rotometer was used to demonstrate that via defects can be modulated by HCLU DI water flow. As can be understood from the graph and the data contained in the table, as the rotometer setting is increased beyond a given amount, the number of via defect counts significantly increases. In one embodiment, the rotometer setting is selected to be 4.0, corresponding to an flow on the order of approximately 1000 ml/min. In one embodiment, the desired rotometer setting is used for wafer load/unload and efficient head clean. With no rotometer in line, as implemented in the current practice, the DI flow is noted to be on the order of 6150 ml/min. From the graph, it is also noted that the via defect counts for unrestricted flow of DI water are on the order of approximately 10.4, corresponding to an approximate order of magnitude more defect counts than the number of defect counts for rotometer flow of 4.0 units.

A comparison analysis of results using the improved CMP tool according to an embodiment of the present disclosure and current practice was carried out. From the analysis, there was observed a strong statistical difference in contact via defects between the process using unrestricted flow and the process using HCLU restricted flow. There occurred an 84% reduction in contact via defects, on the order of 8.8 Normalize Killed Die (NKD) to 1.4 NKD. In addition, for the process using the HCLU restricted flow, substantially no fence defects were observed during an image review.

The embodiments of the present disclosure resolve problems and/or fulfill needs in the art in a new way, in that, the method takes into consideration the effects of charging within the CMP module due to DI water flow. No prior methods are known that address charging in the CMP module, as discussed herein.

During wafer unload from a carrier head as part of a CMP process, the method according to the present embodiments provides a variable pressure input constant flow output inline controller to the DI water line on the HCLU. Such a measure eliminates contact via defects, and changes the way a robot loads/unloads a wafer with respect to the CMP process.

Accordingly, there has been provided a mechanism for preventing galvanic action, the mechanism including a strap or flow restriction. The embodiments apply to a wafer handling tool, as well as, a method of wafer handling.

The methods and apparatus according to the embodiments of the present disclosure can be applied to various semiconductor products, including, 0.25 μm, 0.4 μm, smartMOS, automotive semiconductor, and other type semiconductor products, for example.

The embodiments of the present disclosure provide for an increased yield over prior known techniques. The embodiments of the present disclosure advantageously overcome the problem of premature via failures due to tungsten plug corrosion that previously was not detectable through in-line, end of line, or final test screening. Prior known techniques suffered from yield decrease due to localized charging at an ILD polish step with the CMP tool.

The embodiments include DI water flow rate control during a wafer unload portion of a CMP process. In one embodiment, the method includes the addition of a variable pressure input, constant flow output, in-line controller to the DI water line on HCLU.

The load cup (HCLU) is the interface for transferring wafers to and from the wafer handling robotics and the polishing module. In the process of transferring wafers, the load cup washes the wafers and aligns them for the polishing head. It also washes the polishing head between wafers.

In one embodiment, using a variable flow rotometer has demonstrated that via defects can be modulated by HCLU DI water flow. A strong statistical difference was observed, in that there was obtained an approximate 84% reduction in contact via defects, 8.8 NKD to 1.4 NKD. (Normalized Killed Die)

By now it should be appreciated that there has been provided a method of fabricating highly reliable tungsten interconnects includes use of a variable pressure input constant flow output in-line controller for a DI water line to a wafer carrier associated with wafer processing equipment, and a wafer handling apparatus configured to perform the method. The embodiments of the present disclosure advantageously address an issue of previously unknown tungsten corrosion which had resulted from the prior known tungsten CMP process.

By now it should be further appreciated that there has been provided a method for fabricating highly reliable interconnects comprising: processing a wafer in a chemical-mechanical polishing apparatus, the chemical-mechanical polishing apparatus including a head cleaning load and unload (HCLU) module, a robotic arm, and a wafer carrier head, wherein the HCLU module includes a padded surface for receiving the wafer during loading and unloading operations, the padded surface including a plurality of orifices disposed in a given arrangement, wherein the processed wafer includes at least one of (i) metal interconnect features and (ii) a processed inter-level dielectric, the metal interconnect features being susceptible to metal corrosion defects and the processed inter-level dielectric being susceptible to arcing defects; transferring the processed wafer from the wafer carrier head to the HCLU module, wherein transferring includes using vacuum supplied to the HCLU module for pulling the wafer away from the wafer carrier head to the HCLU module; and transferring the processed wafer from the HCLU module to the robotic arm, wherein transferring includes using a regulated constant flow DI water through the orifices of the HCLU module to detach the processed wafer from the padded surface of the HCLU sufficient for the robotic arm to retrieve the processed wafer, and wherein the use of regulated constant flow DI water through the orifices of the HCLU module minimizes a build-up of static charge and substantially eliminates an occurrence of metal corrosion defects and arcing defects in the processed wafer.

In another embodiment, the HCLU module receives a regulated gas supply input, a vacuum input, and a DI water input, wherein each of the regulated gas supply input, the vacuum input, and the DI water input are selectively coupled to the plurality of orifices through a manifold, further wherein the variable pressure input DI water is regulated inline to provide a constant flow DI water to the plurality orifices at least during a polished wafer unloading from the HCLU to the robotic arm. In addition, inline regulating of the variable pressure input DI water comprises using a flow controller, the flow controller being adjusted to provide a given constant DI water flow during a polished wafer unloading from the HCLU to the robotic arm according to the requirements of the wafer being polished via chemical-mechanical polishing. Furthermore, the flow controller is adjustable to (i) a first constant DI water flow during the polished wafer unloading from the HCLU to the robotic arm and adjustable to (ii) a second constant DI water flow during a cleaning of the wafer carrier head, wherein the second constant DI water flow is greater than the first constant DI water flow.

According to another embodiment, inline regulating of the variable pressure input DI water comprises sharing a regulated supply of DI water with the chemical-mechanical polishing process and further using a flow restrictor on the regulated supply of DI water, the flow restrictor configured to provide a given constant DI water flow, which is less than the regulated supply of DI water, during a polished wafer unloading from the HCLU to the robotic arm according to the requirements of the wafer being polished via chemical-mechanical polishing.

In a further embodiment, the constant DI water flow is selected according to the requirements of (i) maximizing an ability to reduce occurrence of defects, while (ii) maintaining a maximum ability for cleaning the wafer carrier head. For example, in one embodiment, the constant DI water flow is on the order of 1000 ml/min.

In another embodiment, metal corrosion defects further comprise latent defects which are not detectable at wafer level or die level testing, but are activated during actual use of a semiconductor device fabricated from the processed wafer, and wherein the arcing defects are detectable at a wafer probe testing. The metal interconnect features are susceptible to metal corrosion defects in response to an unrestricted flow of DI water during a wafer unloading operation from the wafer carrier head to the HCLU, wherein the unrestricted flow of DI water through the orifices creates a build up of static charge which can discharge upon contact with the wafer, the discharge creating a metal corrosion latent defect. Furthermore, the metal corrosion latent defect comprises at least one of a fence defect, a protruded via, and a dished via.

In a further embodiment, the processed inter-level dielectric is susceptible to arcing defects in response to an unrestricted flow of DI water during a wafer unloading operation from the wafer carrier head to the HCLU, wherein the unrestricted flow of DI water through the orifices creates a build up of static charge which can discharge upon contact with the wafer.

In a still further embodiment, prior to processing the wafer, the method further comprises: transferring the wafer from a robotic arm to the padded surface of the HCLU module of the chemical-mechanical polishing apparatus; and transferring the wafer to the wafer carrier head from the HCLU module. In addition, prior to transferring the processed wafer from the wafer carrier head to the HCLU module, the method further comprises: venting the orifices using a purging gas supplied to the HCLU module. In one embodiment, the purging gas comprises nitrogen, and wherein subsequent to transferring the processed wafer from the HCLU module to the robotic arm, the method further comprises: using the regulated constant flow DI water through the orifices of the HCLU module to clean the wafer carrier head.

In another embodiment, the DI water input comprises unregulated flow and variable pressure DI water house supply. Still further, the DI water is characterized by a given resistivity and further wherein the DI water output through the plurality of orifices is subject to creating a static charge in response to unregulated DI water flow through the plurality of orifices being at a pressure greater than a threshold amount. The plurality of orifices comprises orifices formed within stainless steel. The plurality of orifices can comprise nine orifices that are arranged in two rows, each row containing five orifices, wherein the central orifice is shared between the two rows, the first and second rows further being perpendicular to one another through the central orifice.

In yet another embodiment, a method for fabricating highly reliable interconnects and inter-level dielectrics comprises: processing a wafer in a chemical-mechanical polishing apparatus, the chemical-mechanical polishing apparatus including a head cleaning load and unload (HCLU) module, a robotic arm, and a wafer carrier head, wherein the HCLU module includes a padded surface for receiving the wafer during loading and unloading operations, the padded surface including a plurality of orifices disposed in a given arrangement, wherein the processed wafer includes at least one of (i) metal interconnect features and (ii) a processed inter-level dielectric, the metal interconnect features being susceptible to metal corrosion defects and the processed inter-level dielectric being susceptible to arcing defects; transferring the processed wafer from the wafer carrier head to the HCLU module, wherein transferring includes using vacuum supplied to the HCLU module for pulling the wafer away from the wafer carrier head to the HCLU module; and transferring the processed wafer from the HCLU module to the robotic arm, wherein transferring includes using a regulated constant flow DI water through the orifices of the HCLU module to detach the processed wafer from the padded surface of the HCLU sufficient for the robotic arm to retrieve the processed wafer, and wherein the use of regulated constant flow DI water through the orifices of the HCLU module minimizes a build-up of static charge and substantially eliminates an occurrence of metal corrosion defects and arcing defects in the processed wafer, wherein the HCLU module receives a regulated gas supply input, a vacuum input, and a DI water input, wherein each of the regulated gas supply input, the vacuum input, and the DI water input are selectively coupled to the plurality of orifices through a manifold, further wherein the variable pressure input DI water is regulated inline to provide a constant flow DI water to the plurality orifices at least during a polished wafer unloading from the HCLU to the robotic arm, and wherein inline regulating of the variable pressure input DI water comprises using a flow controller, the flow controller being adjusted to provide a given constant DI water flow during a polished wafer unloading from the HCLU to the robotic arm according to the requirements of the wafer being polished via chemical-mechanical polishing, and wherein metal corrosion defects further comprise latent defects which are not detectable at wafer level or die level testing, but are activated during actual use of a semiconductor device fabricated from the processed wafer, and wherein the arcing defects are detectable at a wafer probe testing.

In another embodiment, a method for fabricating highly reliable interconnects comprises: processing a wafer in a chemical-mechanical polishing apparatus, the chemical-mechanical polishing apparatus including a head cleaning load and unload (HCLU) module, a robotic arm, and a wafer carrier head, wherein the HCLU module includes a padded surface for receiving the wafer during loading and unloading operations, the padded surface including a plurality of orifices disposed in a given arrangement, wherein the processed wafer includes at least one of (i) metal interconnect features and (ii) a processed inter-level dielectric, the metal interconnect features being susceptible to metal corrosion defects and the processed inter-level dielectric being susceptible to arcing defects; transferring the processed wafer from the wafer carrier head to the HCLU module, wherein transferring includes using vacuum supplied to the HCLU module for pulling the wafer away from the wafer carrier head to the HCLU module; and transferring the processed wafer from the HCLU module to the robotic arm, wherein transferring includes using a regulated constant flow DI water through the orifices of the HCLU module to detach the processed wafer from the padded surface of the HCLU sufficient for the robotic arm to retrieve the processed wafer, and wherein the use of regulated constant flow DI water through the orifices of the HCLU module minimizes a build-up of static charge and substantially eliminates an occurrence of metal corrosion defects and arcing defects in the processed wafer, wherein prior to processing the wafer, the method further comprising: transferring the wafer from a robotic arm to the padded surface of the HCLU module of the chemical-mechanical polishing apparatus; and transferring the wafer to the wafer carrier head from the HCLU module, and wherein prior to transferring the processed wafer from the wafer carrier head to the HCLU module, the method further comprising: venting the orifices using a purging gas supplied to the HCLU module, and wherein the purging gas comprises nitrogen, and wherein subsequent to transferring the processed wafer from the HCLU module to the robotic arm, the method further comprising: using the regulated constant flow DI water through the orifices of the HCLU module to clean the wafer carrier head.

Because the apparatus implementing the present invention is, for the most part, composed of components and circuits known to those skilled in the art, details will not be explained in any greater extent than that considered necessary as illustrated above, for the understanding and appreciation of the underlying concepts of the present invention and in order not to obfuscate or distract from the teachings of the present invention.

Although the invention has been described with respect to specific conductivity types or polarity of potentials, skilled artisans appreciated that conductivity types and polarities of potentials may be reversed.

Moreover, the terms "front," "back," "top," "bottom," "over," "under" and the like in the description and in the claims, if any, are used for descriptive purposes and not necessarily for describing permanent relative positions. It is understood that the terms so used are interchangeable under appropriate circumstances such that the embodiments of the invention described herein are, for example, capable of operation in other orientations than those illustrated or otherwise described herein.

Although the invention is described herein with reference to specific embodiments, various modifications and changes can be made without departing from the scope of the present invention as set forth in the claims below. For example, while the embodiments have been discussed with respect to the CMP processing tools, the embodiments can also be applied to other wafer processing tools and post polished tungsten wafer handling. Accordingly, the specification and figures are to be regarded in an illustrative rather than a restrictive sense, and all such modifications are intended to be included within the scope of the present invention. Any benefits, advantages, or solutions to problems that are described herein with regard to specific embodiments are not intended to be construed as a critical, required, or essential feature or element of any or all the claims.

The term "coupled," as used herein, is not intended to be limited to a direct coupling or a mechanical coupling.

Furthermore, the terms "a" or "an," as used herein, are defined as one or more than one. Also, the use of introductory phrases such as "at least one" and "one or more" in the claims should not be construed to imply that the introduction of another claim element by the indefinite articles "a" or "an" limits any particular claim containing such introduced claim element to inventions containing only one such element, even when the same claim includes the introductory phrases "one or more" or "at least one" and indefinite articles such as "a" or "an." The same holds true for the use of definite articles.

Unless stated otherwise, terms such as "first" and "second" are used to arbitrarily distinguish between the elements such terms describe. Thus, these terms are not necessarily intended to indicate temporal or other prioritization of such elements.

What is claimed is:

1. A method for fabricating highly reliable interconnects, comprising:

processing a wafer in a chemical-mechanical polishing apparatus, the chemical-mechanical polishing apparatus including a head cleaning load and unload (HCLU) module, a robotic arm, and a wafer carrier head, wherein the HCLU module includes a padded surface for receiving the wafer during loading and unloading operations, the padded surface including a plurality of orifices disposed in a given arrangement, wherein the processed wafer includes at least one of (i) metal interconnect features and (ii) a processed inter-level dielectric, the metal interconnect features being susceptible to metal corrosion defects and the processed inter-level dielectric being susceptible to arcing defects;

transferring the processed wafer from the wafer carrier head to the HCLU module, wherein said transferring includes using vacuum supplied to the HCLU module for pulling the wafer away from the wafer carrier head to the HCLU module; and transferring the processed wafer from the HCLU module to the robotic arm, wherein said transferring includes using a variable pressure input DI water through the orifices of the HCLU module to detach the processed wafer from the padded surface of the HCLU sufficient for the robotic arm to retrieve the processed wafer, and wherein the use of variable pressure input DI water through the orifices of the HCLU module minimizes a build-up of static charge and substantially eliminates an occurrence of metal corrosion defects and arcing defects in the processed wafer, wherein the HCLU module receives a regulated gas supply input, a vacuum input, and a DI water input, wherein each of the regulated gas supply input, the vacuum input, and the DI water input are selectively coupled to the plurality of orifices through a manifold, further wherein the variable pressure input DI water is regulated inline to provide a constant flow DI water to the plurality orifices at least during a polished wafer unloading from the HCLU to the robotic arm, and further wherein inline regulating of the variable pressure input DI water comprises sharing a regulated supply of DI water with the chemical-mechanical polishing process and further using a flow restrictor on the regulated supply of DI water, the flow restrictor configured to provide a given constant DI water flow, which is less than the regulated supply of DI water.

2. The method of claim 1, wherein inline regulating of the variable pressure input DI water comprises using a flow controller, the flow controller being adjusted to provide a given constant DI water flow during a polished wafer unloading from the HCLU to the robotic arm according to the requirements of the wafer being polished via chemical-mechanical polishing.

3. The method of claim 2, further wherein the flow controller is adjustable to (i) a first constant DI water flow during the polished wafer unloading from the HCLU to the robotic arm and adjustable to (ii) a second constant DI water flow during a cleaning of the wafer carrier head, wherein the second constant DI water flow is greater than the first constant DI water flow.

4. The method of claim 1, wherein the constant DI water flow is selected according to the requirements of (i) maximizing an ability to reduce occurrence of defects, while (ii) maintaining a maximum ability for cleaning the wafer carrier head.

5. The method of claim 1, wherein the constant DI water flow is on the order of 1000 ml/min.

6. The method of claim 1, wherein metal corrosion defects further comprise latent defects which are not detectable at wafer level or die level testing, but are activated during actual use of a semiconductor device fabricated from the processed wafer, and wherein the arcing defects are detectable at a wafer probe testing.

7. The method of claim 1, wherein the metal interconnect features are susceptible to metal corrosion defects in response to an unrestricted flow of DI water during a wafer unloading operation from the wafer carrier head to the HCLU, wherein the unrestricted flow of DI water through the orifices creates a build up of static charge which can discharge upon contact with the wafer, the discharge creating a metal corrosion latent defect.

8. The method of claim 7, further wherein the metal corrosion latent defect comprises at least one of a fence defect, a protruded via, and a dished via.

9. The method of claim 1, wherein the processed inter-level dielectric is susceptible to arcing defects in response to an unrestricted flow of DI water during a wafer unloading operation from the wafer carrier head to the HCLU, wherein the unrestricted flow of DI water through the orifices creates a build up of static charge which can discharge upon contact with the wafer.

10. The method of claim 1, wherein prior to processing the wafer, the method further comprising:

transferring the wafer from a robotic arm to the padded surface of the HCLU module of the chemical-mechanical polishing apparatus; and transferring the wafer to the wafer carrier head from the HCLU module.

11. The method of claim 1, wherein prior to transferring the processed wafer from the wafer carrier head to the HCLU module, the method further comprising:

venting the orifices using a purging gas supplied to the HCLU module.

12. The method of claim 11, wherein the purging gas comprises nitrogen, and wherein subsequent to transferring the processed wafer from the HCLU module to the robotic arm, the method further comprising:

cleaning the wafer carrier head using the variable pressure input DI water through the orifices of the HCLU module to clean the wafer carrier head.

13. The method of claim 1, wherein the DI water input comprises unregulated flow and variable pressure DI water house supply.

14. The method of claim 1, wherein the DI water output through the plurality of orifices is subject to creating a static charge in response to unregulated DI water flow through the plurality of orifices being at a pressure greater than a threshold amount.

15. The method of claim 1, wherein the plurality of orifices comprises orifices formed within stainless steel.

16. The method of claim 1, wherein the plurality of orifices comprises nine orifices that are arranged in two rows, each row containing five orifices, wherein the central orifice is shared between the two rows, the first and second rows further being perpendicular to one another through the central orifice.

* * * * *